US006955546B1

(12) United States Patent
Huang

(10) Patent No.: US 6,955,546 B1
(45) Date of Patent: Oct. 18, 2005

(54) ELECTRICAL CONNECTOR WITH SHUTTER

(75) Inventor: Chien-Hsun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/029,106

(22) Filed: Dec. 31, 2004

(30) Foreign Application Priority Data

Jun. 11, 2004 (TW) ..... 93116826 A

(51) Int. Cl.[7] ..... H01R 13/44
(52) U.S. Cl. ..... 439/135; 439/137
(58) Field of Search ..... 439/135, 136, 439/137, 138, 139, 140

(56) References Cited

U.S. PATENT DOCUMENTS 5,796,579 A * 8/1998 Nakajima et al. ..... 361/683
6,832,923 B2 * 12/2004 Sasame et al. ..... 439/137
6,877,999 B2 * 4/2005 Hashimoto ..... 439/138
2002/0177336 A1 * 11/2002 Sasame et al. ..... 439/142
2003/0077929 A1 4/2003 Funatsu
2004/0067667 A1 4/2004 Kuroki
2004/0092145 A1 * 5/2004 Sasam et al. ..... 439/137

* cited by examiner

*Primary Examiner*—Thanh-Tam Le
(74) *Attorney, Agent, or Firm*—Wei Te Chung

(57) ABSTRACT

An electrical connector (1) is provided with a pair of shutter members (31, 32). The connector comprises a housing (10), a number of electrical contacts (20) received in the housing. The housing has a mating portion (21) which the contact arranged in. The shutter members are displaced on a front surface of the housing for covering the mating portion. A pair of coil springs (5) respectively connect the shutter members with the housing. When a complementary connector is inserted in the connector along a mating direction, a guide post provided by the complementary connector urge the shutter member always moving along a direction which is perpendicular to the mating direction and apart from each other to expose the mating portion. The pair of coil springs urge the pair of shutter members always closing toward each other.

9 Claims, 4 Drawing Sheets

ELECTRICAL CONNECTOR WITH SHUTTER

BACKGROUND OF THE INVENTION

1. Field of the Invention

The present invention is generally related to the art of electrical connectors, and more particularly, to an electrical connector which includes a movable shutter for protecting the contacts of the electrical connector.

2. Description of Related Art

Electrical connectors are widely used in a variety of applications for making electrical contacting within an electrical system or electrical systems. Generally, an electrical connector has a mating portion with a plurality of contacts located therein. The mating portion is configured to electrically mate with a complementary connector. When the complementary connector is not mated with the mating portion of the connector, the mating portion is exposed in the exterior. Thus, foreign matter such as dust and the like may enter the exposed mating portion and adhere to the contacts, whereby the electrical connection may be interrupted or compromised when the complementary connector mates with the mating portion of the connector. To protect the contacts located in the mating portion of the electrical connector from foreign matters, the electrical connector is provided with a shutter covering the mating portion and configured to freely move from a closed position protecting the mating portion to an opened position exposing the mating portion.

U.S. Patent application Pub. No. 2003/0077929 discloses an electrical connector with a shutter. The electrical connector includes a mating portion, a plurality of contacts located in the mating portion and a shutter made by a pair of shutter member for protecting the contacts. The shutter comprises a pair of sliding sections provided at edges thereof, a pair of arms provided at opposite ends in a lengthwise direction thereof. The arms comprise shafts or bearing holes so that the pair of the shutter member are rotatablely attached to opposite ends in a lengthwise of the electrical connector. The connector further comprises a coil spring connecting the pair of the shutter member and pulling the pair of shutter members toward each other to cover the mating portion. A complementary connector is provided with a guide portion to fit into the mating portion of the connector. The guide portion urges the sliding sections of the shutter to expose the mating portion for electrically connecting with the complementary connector.

In the former connector mentioned above, the shutter is rotatablely supported by and fixed on the housing of the connector. The shutter can move rotatablely from a closed position where the shutter covers the mating portion to an opened position where the complementary connectors is fit into the connector. However, problems may be raised due to the shutter' moving by rotatable manner. One main problem is that, when the shutter rotatablely reaches to the opened position, the shutter is located at two opposite longitudinal sides of the connector. Thus, the shutter takes up too much space above a printed circuit board which the connector is mounted on so that the printed circuit board cannot hold other electronic components in the space which the shutter passes through during rotatablely moving. At the same time, with the development of integration and miniaturization, a variety of electronic systems are required to make as small as possible, and that in limited space should be held electronic components as more as possible. Obviously, the former connector with the shutter cannot satisfactorily reach to the requirement. Hence, an electrical connector with another type of shutter is highly desired to adequately meet the requirement above mentioned.

SUMMARY OF THE INVENTION

Accordingly, an object of the present invention is to provide an electrical connector with a shutter, the electrical connector takes up little space of a printed circuit board which the connector is connected to.

In order to achieve the object set forth, an electrical connector with a shutter is provided. The electrical connector comprises a housing and a plurality of electrical contacts received in the housing. The housing has a mating portion which the contacts are arranged in. The shutter members are disposed on a front surface of the housing for covering the mating portion, and this position is referred as a closed position. A pair of coil springs respectively connect the shutter members with the housing. When a complementary connector is inserted in the connector along a mating direction, a guide post provided by the complementary connector urge the shutter member always moving along a direction which is perpendicular to the mating direction and apart from each other to expose the mating portion. When the complementary is completely inserted in the connector, the shutter members reach to an opened position and absolutely expose the mating portion to the complementary connector. The pair of coil springs urge the pair of shutter members always toward the closed position. Moreover, each shutter member has at least one slit, the front surface of the housing has at least one block, and the at least one slit is constrained by the block to enable the shutter member accurately move along the direction which is perpendicular to the mating direction during moving process.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
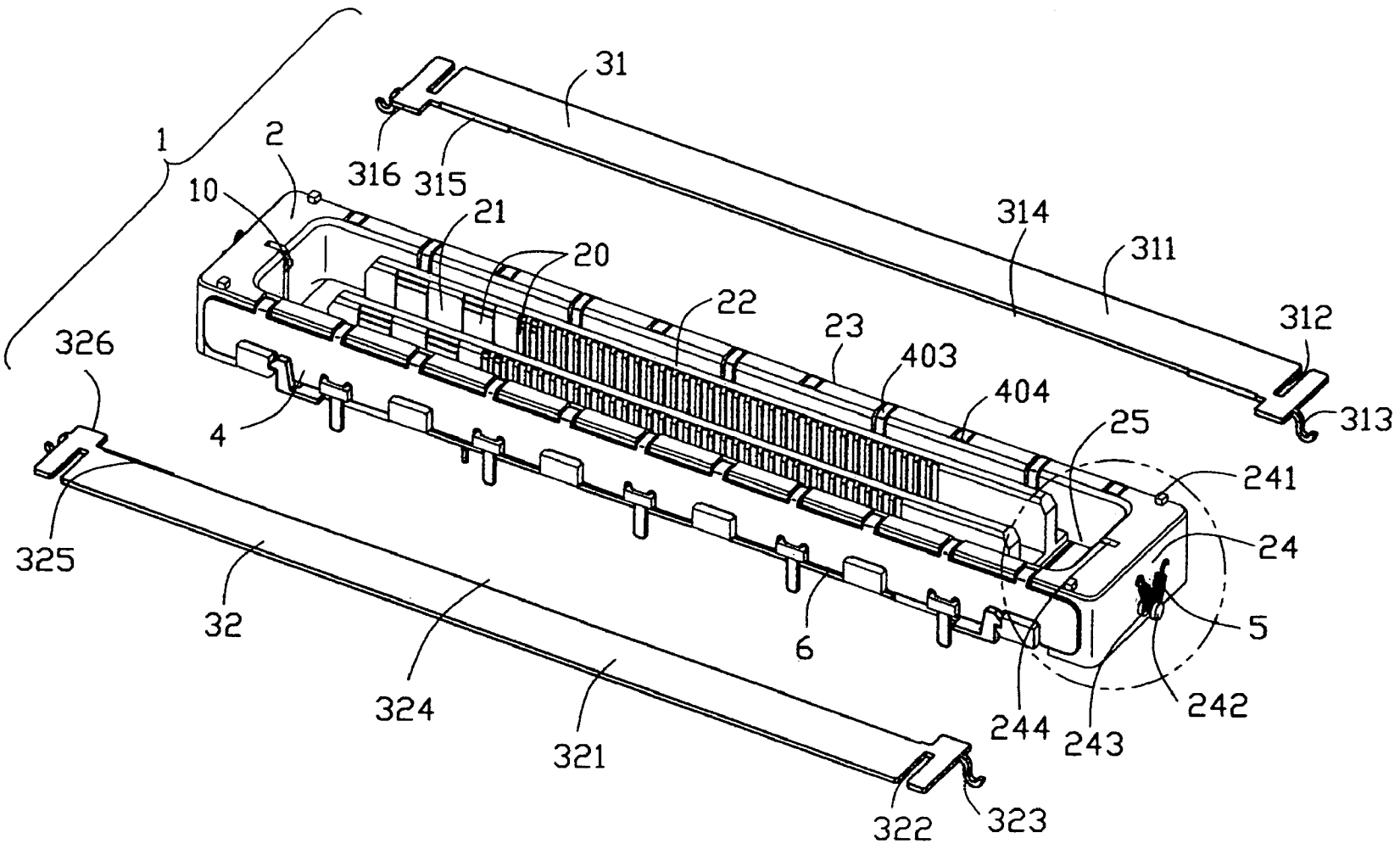
FIG. 1 is a perspective view of an electrical connector in accordance with the present invention, with a pair of shutter member not assembled thereon.
Figure 5:
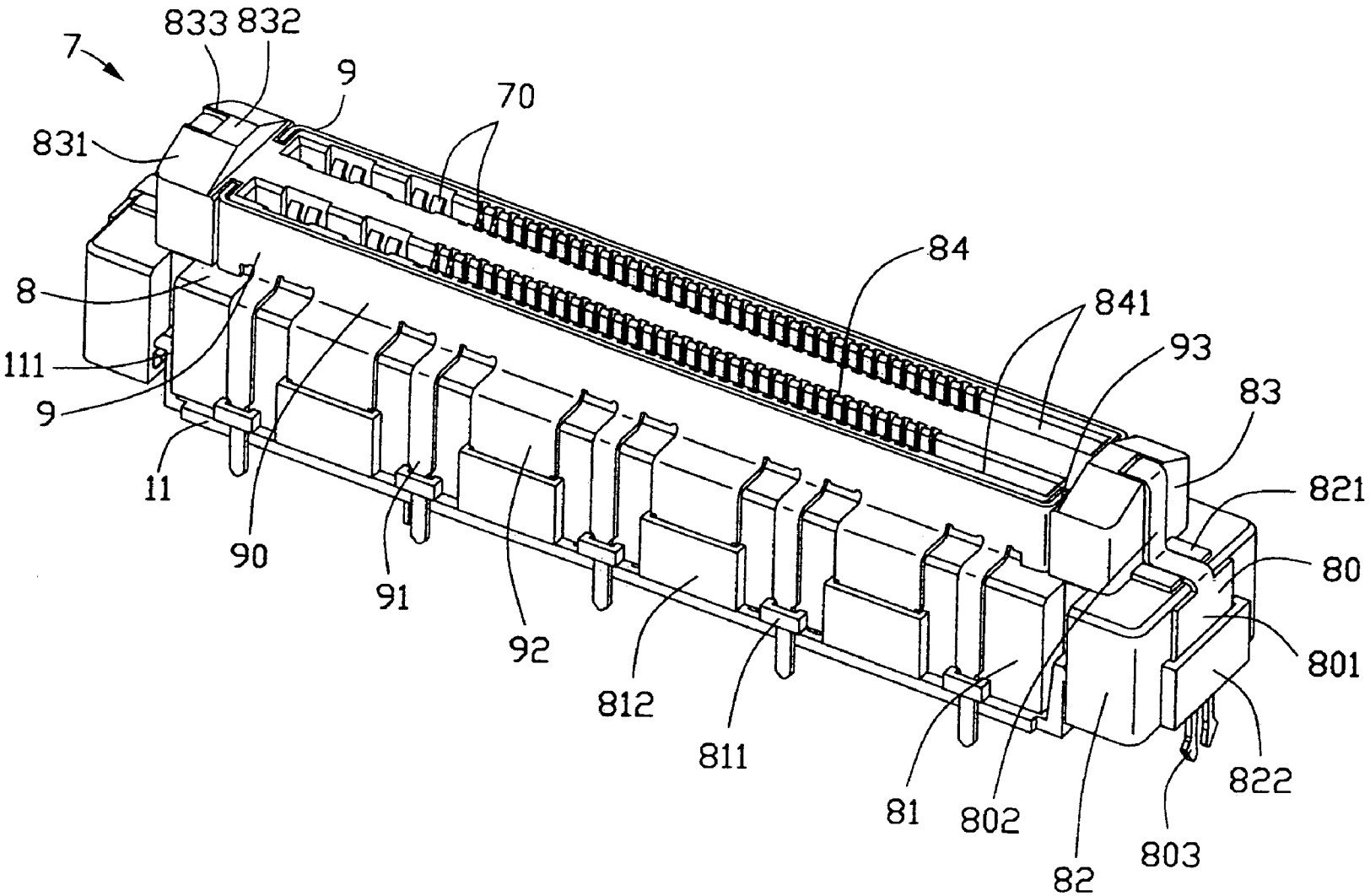
FIG. 5 is an assembled, perspective view of a complementary connector which is used for mating with the electrical connector.

Referring to FIG. 1 and FIG. 5, an electrical connector 1 in accordance with the present invention is provided with a shutter 3. The connector 1 comprises an insulated housing 2, a plurality of contacts 20 arranged in the housing 2, a shielding member 4, a shutter 3 and a biasing member such as a pair of coil springs 5 in this embodiment. The shutter 3 consists of a pair of shutter member 31,32.

The housing 2 has a mating portion 21 where the plurality of contacts arranged in a longitudinal direction. The pair of shutter members 31, 32 are supported by the housing 10 for covering the mating portion 11. A surface of the connector 1 proximate to the pair of the shutter member 31, 32 is referred as a front surface and an opposite surface connected to a printed circuit board is referred as a rear surface. The mating portion 21 is surrounded by a pair of opposite longitudinal walls 23 and a pair of opposite transverse walls 24. The mating portion 21 of the housing 1 comprises two substantially elongated platforms 22 extending from a bottom wall of the mating portion 21 to the front surface and a pair of guide holes 25 for receiving a pair of guide posts 82 provided on a complementary connector 7. Both sides of the each platform 22 along the longitudinal direction have a plurality of channels for fixing the contacts 20 therein. The guide holes 25 are respectively located at two end portions of the mating portion 21 along the longitudinal direction and extends through the front surface and the rear surface. The opposite transverse walls 24 each has a groove 244 which is communication with the guide hole 25 and extends through the front surface, two blocks 241 protruding from the front surface and a columned projection 242 extending outwardly from the outside surface thereof. A pair of grounding pins 10 are respectively fixed in the corresponding grooves 244 and each has a free ends exposing in the guide hole 25. Each of the blocks 241 has a substantial rectangular cross section and is arranged in a position which is adjacent to the outside surface of the opposite longitudinal walls 23. A radiant recess is provided around a peripheral of the columned projection 242 to form a shaft 243 in the middle of the columned projection 242.

Figure 2:
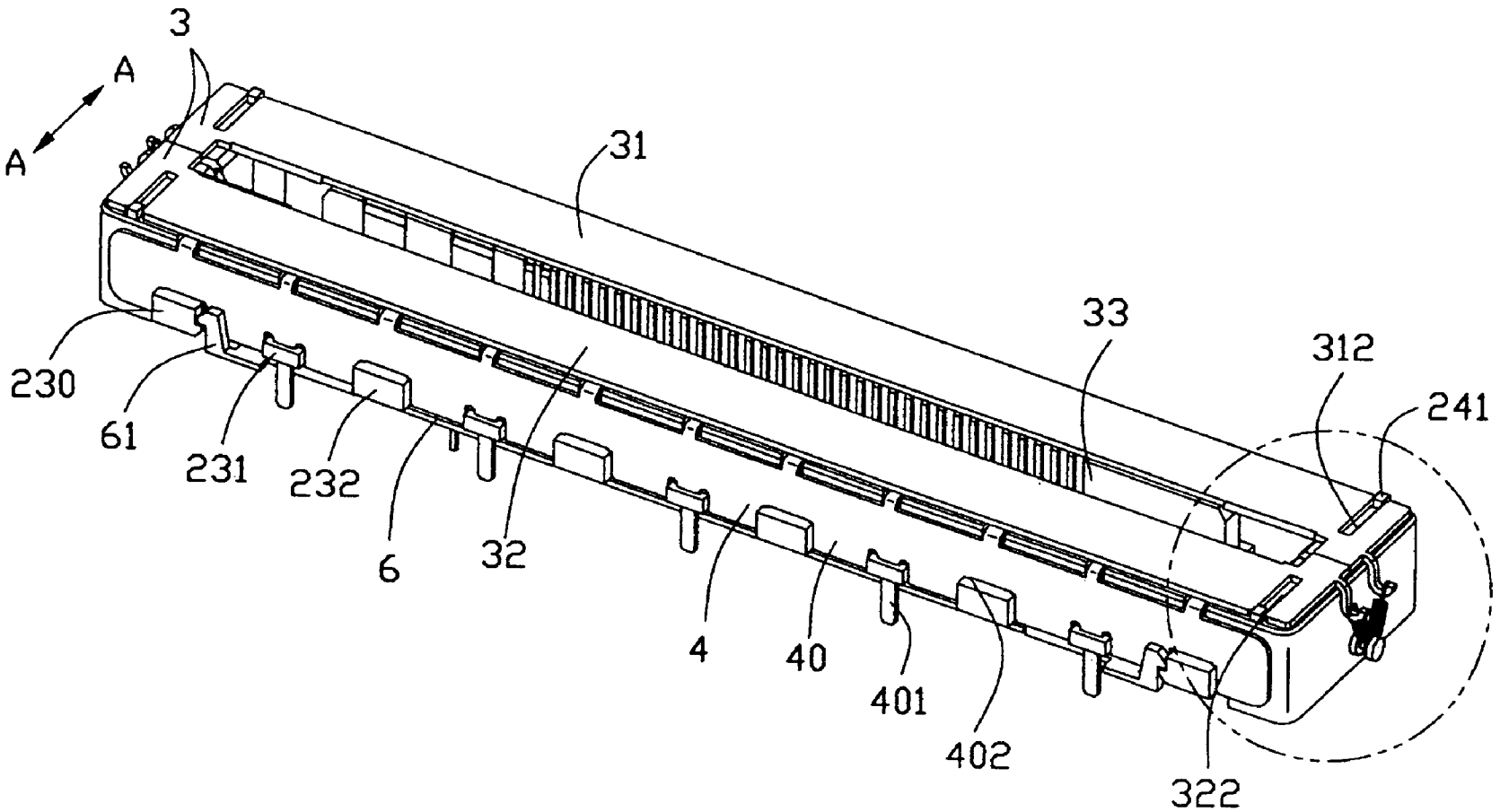
FIG. 2 is an assembled, perspective view of the electrical connector in accordance with the present invention.
Figure 4:
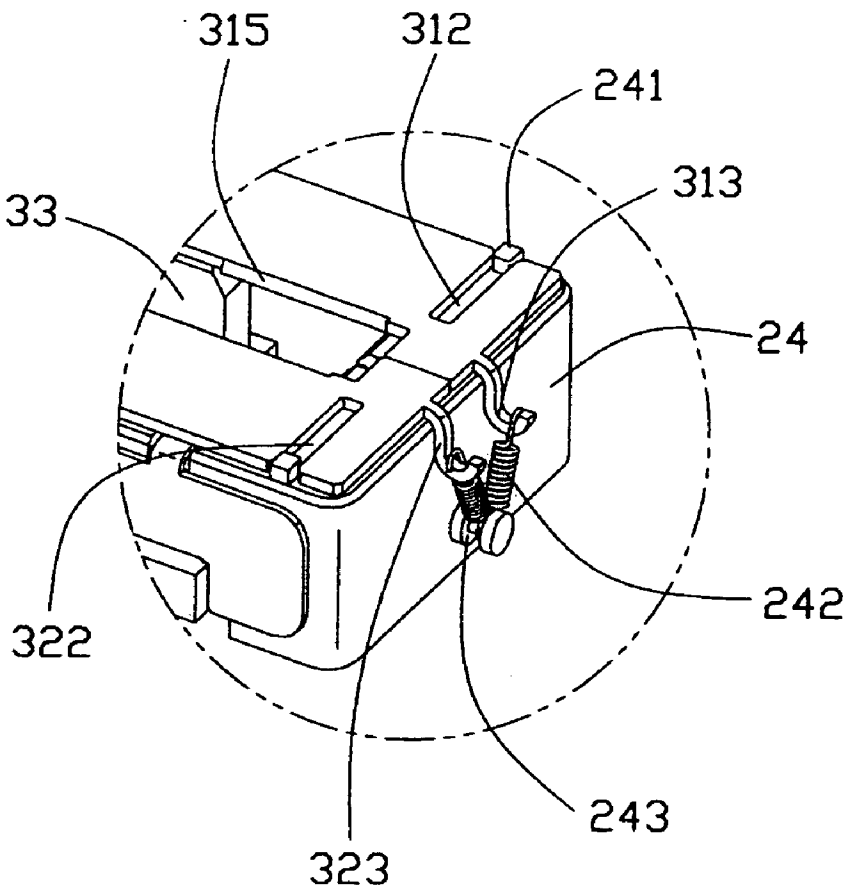
FIG. 4 is a partial, enlarged view of FIG. 2.

The shutter members 31, 32 is displaced on the front surface of the connector 1 covering the mating portion 21. The position as shown in FIG. 2 is referred as a closed portion. The shutter members 31, 32 are in the same shape and respectively include a main plate 311, 321, a pair of claws 313, 323 extending downward and away from transverse sides of the main plate 311, 321, a pair of slits 312, 322 and a cutout 314, 324. One free end of one coil spring 5 connects to the claw 313 of the shutter member 31 and the other free end of the coil spring 5 connects to the shaft 243 of the housing 2. Similarly, the shutter member 32 connects with the housing 2 via two free ends of the other coil spring 5 respectively connecting to the claw 323 and shaft 243. The cross-sectional area of the shaft 243 is smaller than that of the other part of the columned projection 242 so that the coil spring 5 would hardly pivot out of the shaft 243. Each block 241 provided on the front surface of the housing 2 is retained in corresponding slit 312, 322. The cutout 314 of the shutter member 31 combines with the cutout 324 of the shutter member 32 to form a single opening 33. The single opening 33 has two pair of guide units 315, 325 respectively formed longitudinal edges of the cutout 314 and the cutout 324. When an external force is exerted on the shutter members 31, 32, the pair of slits 312, 322 are constrained by the blocks 241 so that the shutter member 31, 32 start separating from each other along a direction of double-headed arrows "A" (hereafter referred as direction "A") which is perpendicular to a mating direction. The external force is exerted on guide unites 315, 325 for easily opening the shutter members 31, 32, and in this embodiment, the external force is provided by the guide post 82 of the complementary connector 7 (shown in FIG. 5). The main plate 311 has an inner edge 316 which the cutout 314 formed at and an outer edge. In the same way, the main plate 321 has an inner edge 326 and an outer edge. When the complementary connector 7 disconnects with the connector 1, the shutter members 31, 32 move close to each other via the recover-force provided by the coil springs 5 until the inner edge 316 of the shutter members 31 contacts with the inner edge 326 of the shutter member 32(as shown in FIG. 2).

The shielding member 4 covers with the housing 2 for protecting the contacts 20 from the electromagnetic interference. The shielding member 4 consists of two same shape metal shells. Each metal shell has a substantially rectangular main plate 40, a plurality of mounting legs 401 extending downward from a bottom edge of the main plate 40 and a plurality of long fixed pieces 403 and short fixed pieces 404 extending from a top edge of the main plate 40. The mounting legs 401 extends though the rectangular protrusions 231 projecting from lower portions of the longitudinal walls 23 of the housing 2 to mounting a printed circuit board. The fixed pieces 403, 404 are fixed on top sides of the longitudinal walls 23, and the long fixed pieces 403 each has a contact portion contacting with a metal plate 90 provided by the complementary connector 7. Moreover, the metal shell further has a plurality of rectangular cutouts 402 which are located alternatively with respect to the projections 231. Accordingly, the longitudinal walls 23 have tubers 232 for mating with the cutouts 402.

The connector 1 further comprises a guide plate 6 arranged to the bottom of the housing 2. Latch arms 61 locking the guide plate 6 to the housing 2 are provided on both ends in the longitudinal direction of the guide plate 6. The contacts 20 each has a connecting portion extending through the guide plate 6 to connect with a printed circuit board (not shown).

The complementary connector 7 will be described in detail with reference to FIG. 5. The complementary connector 7 has a housing 8. The housing 8 comprises a base portion 81, mounting portions 82 located at opposite ends of the base portion 81, a mating portion 84 and the pair of guide posts 83 protruding from two ends of the mating portion 84. The mating portion 84 has two rectangular grooves 841 for receiving the platforms 22 of the connector 1. Both sides of each groove 841 have a plurality of channels for securing a plurality of contacts 70 therein. The guide post 83 extends beyond the mating portion 84 and has inclined surface 821 and a plane surface 832 between the inclined surfaces 831. The mounting portions 82 each has a bulge 822 projecting from the transverse surface thereof, two projections 821 projecting from the top surface thereof and a channel formed between the two projections 821.

The complementary connector 7 further comprise two grounding sheets 80 located opposite ends of the mounting portions 82. Each grounding sheet 80 comprises a main portion 801 extending through and fixed in the bulge 822, a L-shaped bent portion 802 extending from the top edge of the main portion 801 and a locking portion 803 extending downward from the bottom edge of the main portion 801. The L-shaped bent portion 802 has a horizontal portion retained in the channel between the two projections 821 and a vertical portion extending against a sidewall of the guide post 83. A latch portion formed at a free end of the vertical portion extends into a notch provided on the plane surface 832 of the guide post 83. When the complementary connector 7 is plugged into the connector 1 along the mating direction, the vertical portion electrical contact with the ground pin 10 to cause electrostatic discharge for prevent the electrostatic electricity from damaging the contacts 20, 70.

Two shielding shells 9 are assembled on the housing 8 for protecting the contact 70 from electromagnetic interference. Each shielding shell 9 has a metal plate 90 partially encircling the mating portion 84. A plurality of mounting legs 91 and fixed sheets 92 extends from the bottom edge of the metal plate 90. The mounting legs 91 and the fixed sheets 92 are respectively retained in a plurality of protrusions 811, 812 provided on the housing 2. Moreover, the mounting legs 91 extending through the protrusions 811 to fix into a printed circuit board (not shown). The metal plate 90 has a pair of bent portion 93 which are respectively retained in corresponding clearance provided between the guide post 83 and the mating portion 84. For the configuration of the bent portions 93, the shielding shells 9 may hardly move along the longitudinal direction.

A guide plate 11 is arranged to the bottom of the housing 8. Latch arms 111 locking the guide plate 11 to the housing 8 are provided on both ends in the longitudinal direction of the guide plate 11. The latch arms 111 are retained in passageways provided between the base portion 81 and the two mounting portions 82 of the housing 8. The contacts 70 each has a connecting portion extending through the guide plate 11 to connect with the printed circuit board.

Figure 3:
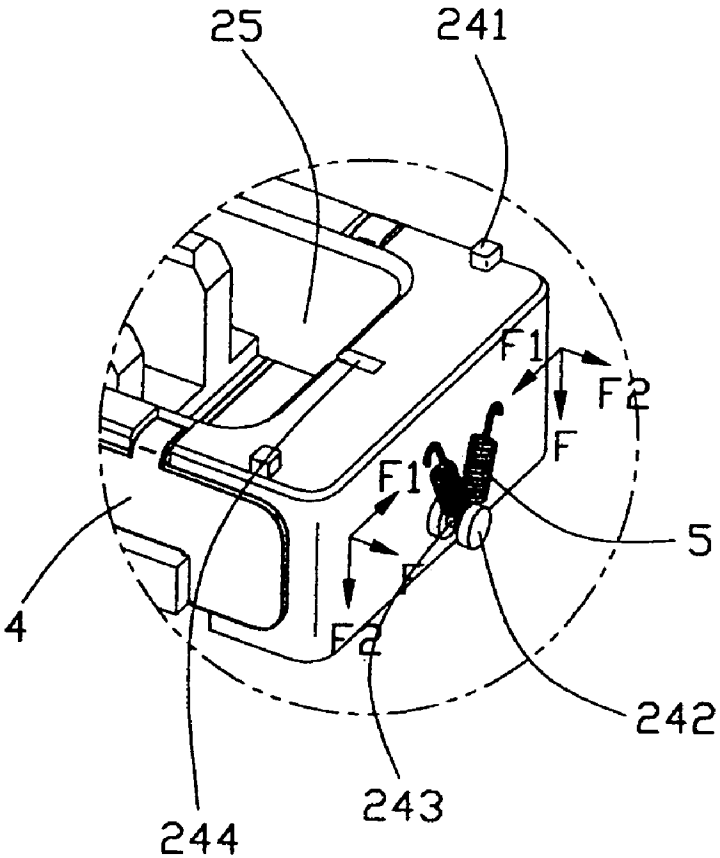
FIG. 3 is a partial, enlarged view of FIG. 1.

When the complementary connector 7 is inserted into the connector 1 along the mating direction, the shutter members 31, 32 are pressed by the guide posts 83 to move along the direction "A" (shown in FIG. 2) and separate away from each other. Namely, the shutter member 31, 32 move from the closed position covering the mating portion 21 to the opened position exposing the mating portion 21 for connecting with the complementary connector 7. In the insertion process, the shutter members 31, 32 always connect with housing 2 via the coil springs 5. The coil springs 5 respectively exert a changeable external force "F" on the shutter member 31 and the shutter member 32. With reference to FIG. 3, the external force "F" can be disintegrated into a horizontal force "F1" and a vertical force "F2". The horizontal force "F1" urges the shutter members 31, 32 always toward the closed position along a direction opposite to the direction "A". The vertical force "F2" enable the shutter members 31, 32 always against the front surface of the housing 2 during the moving process.

Then, when the insertion of the complementary connector 7 continues until the mating portion 84 of the complementary connector 7 is absolutory fit into the mating portion 21 of the connector 1, the guide posts 83 are received in the guide holes 25, that is, the shutter members 31, 32 reach to the opened position and absolutory expose the mating portion 21 to the complementary 7. Moreover, the pair of slits 312, 322 of the shutter members 31, 32 are constrained by the blocks 241 during the moving process so that the shutter members 31, 32 hardly move along a longitudinal direction unexpectedly. When the complementary connector 7 is removed, the shutter members 31, 32 are urged to close to each other by the horizontal force "F1".

As the shutter members 31, 32 separate from each other along the direction "A", the complementary connector 7 may be fleetly inserted into the connector 1. Moreover, the printed circuit board which the connector 1 connected with has enough space to hold other electronic components thereon around the connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a housing having a mating portion defining a mating direction;

a plurality of contacts located in the mating portion;

a shutter supported by the housing and being movable relative to the housing between a closed position, shielding the mating portion and an opened position, exposing the mating portion, the shutter moving always along a direction perpendicular to the mating direction; and a biasing member urging the shutter toward the closed position;

wherein the biasing member has at least one coil spring and the shutter has a pair to shutter members;

wherein each of the pair of the shutter members has a pair of claws, the housing has two opposite transverse walls and shafts extending from the transverse walls, and one end of the at least one coil spring connects to each claw of the each shutter member and another end connects to each of the shafts of the housing;

wherein the each shutter member has at least one slit, the housing has a front surface defining at least one block, and the at least on slit is constrained by the block to enable the shutter members accurately move along the direction which is perpendicular to the mating direction;

wherein the each shutter member has an inner edge and an outer edge opposite to the inner edge, a single opening is formed by cutouts combining with each other when the shutter members are in the closed position; and wherein the cutouts have guide units facilitating a complementary connector to open the shutter members to expose the mating portion.

2. The electrical connector as claimed in claim 1, wherein the shutter is disposed at a front surface of the housing for covering the mating portion.

3. The electrical connector as claimed in claim 2, wherein the biasing member provides a force exerted on the shutter and enabling the shutter to move closely along the front surface.

4. The electrical connector as claimed in claim 1, wherein the biasing member connects the shutter member to the housing.

5. The electrical connector as claimed in claim 1, wherein each transverse wall has a columned projection, a radiant recess is provided around a peripheral of the projection to form the shaft.

6. The electrical connector as claimed in claim 5, wherein the shaft is formed in the middle of the projection, and the area of shaft is smaller than that of the other part of the projection.

7. The electrical connector as claimed in claim 1, wherein each block has a rectangular cross section.

8. The electrical connector as claimed in claim 1, wherein each slit extends through the outer edge of each shutter member.

9. The electrical connector as claimed in claim 1, wherein when the shutter members are in the closed position, the inner edges of the shutter members contact with each other.

* * * * *